US005756913A

United States Patent [19]

Gilmore

[11] Patent Number: 5,756,913

[45] Date of Patent: May 26, 1998

[54] AUTOMATIC PIANO TUNER

[76] Inventor: Don A. Gilmore, 412 W. 8th St., #608, Kansas City, Mo. 64105

[21] Appl. No.: 722,999

[22] Filed: Sep. 30, 1996

[51] Int. Cl.[6] ..... G10G 7/02

[52] U.S. Cl. ..... 84/454; 84/458

[58] Field of Search ..... 84/454, 458

[56] References Cited

U.S. PATENT DOCUMENTS

| | | | |
|---|---|---|---|
| 4,481,857 | 11/1984 | Havener | 84/454 |
| 4,958,550 | 9/1990 | Kugimoto | 84/454 |
| 5,016,515 | 5/1991 | Scott | 84/454 |
| 5,065,660 | 11/1991 | Buda | 84/200 |
| 5,396,827 | 3/1995 | Miller et al. | 84/454 |

*Primary Examiner*—Michael L. Gellner

*Assistant Examiner*—Shih-yung Hsieh

*Attorney, Agent, or Firm*—Patent & Trademark Services; Thomas Zack; Joseph H. McGlynn

[57] ABSTRACT

A piano tuning system having an electronic control circuit which receives sound through a microphone for a piano key. Based upon a comparison of this sound with stored piano fundamental frequencies, signals are sent to a drive unit. An electrically driven drive unit has a push/pull solenoid with an actuator which can move an internal drive shaft along a spline shaft. Movement of the drive shaft with respect to associated clutches moves any of three worm gears, each having dependent tuning head wrenches which turn the piano's tuning pins. Adjustments may be made to the spacing between worm gears to squeeze or expand their relative positions with respect to each other by an external housing thumb wheel. A method for implementing the tuning of piano notes is also set forth.

7 Claims, 5 Drawing Sheets

AUTOMATIC PIANO TUNER

BACKGROUND OF THE INVENTION

The tuning of pianos has been accomplished many ways over the years. Initially, it depended almost entirely on the trained ear of the tuner using a tuning fork and perhaps a few adjustment tools. With the advance of audio electronics tuning methods became more sophisticated resulting in a greater interplay between the tuner and the electronic and other instruments employed in the process. The current piano tuning invention utilizes an electronic control unit having a condenser microphone, digital LED readout and buttons leading to a drive unit. The drive unit has a motor driven timing belt used to control a 3-piece worm. Each segment of the worm can be driven separately and each is connected to tuning wrench heads. In this way each note in a piano has three strings tuned in unison simultaneously by the worm segments. As the engaged piano tuning pins get closer together for a given note, the wrenches may be adjusted via a thumb wheel to spread or squeeze the worm gear bearing blocks.

DESCRIPTION OF THE PRIOR ART

Electromechanical devices have been used to tune musical instruments, including pianos, over the last few years. For example, in U.S. Pat. No. 4,481,857 to Havener, the instrument is vibrated and these oscillations are converted into electrical signals. Harmonic components for the signal are eliminated and the resultant signal is visually displayed for a given duration. Additional vibrations for the same element are adjusted to the known frequency to permit adjustment for a zero difference between the two actuations. In the U.S. Pat. No. 4,958,550 to Kugimoto, a tuning apparatus for a keyboard musical instrument is disclosed having a predetermined load applicator and a deviation calculator. Deviations between the applied load and a required frequency of vibration are used with a rotating tuning device to reduce them to zero.

The U.S. Pat. No. 5,016,515 to Scott discloses an aid to tuning musical instruments using a microprocessor-controlled frequency standard used to control a shift-register whose data is the digitized microphone detected sound. Preloaded latches receive the shift registers output and are used to control an array of error indicator lights. By stabilizing the lights the correct frequency is obtained.

In U.S. Pat. No. 5,396,827 to Miller et al., electronic tuning devices have selected pairs of LED's to indicate the tuning range width for a given range mode. The nearest note with an in-tune and out-of tune condition is sensed and indicated. The present invention is an electromechanical apparatus which displays and corrects all 3 strings of a piano note simultaneously through a worm gear drive as set forth in this specification.

SUMMARY OF THE INVENTION

A piano tuner apparatus having an electronic circuit control system for a drive unit. The drive unit's gear motor drives a timing belt which then drives a 3-piece worm gear through one-way clutches. A spline connection between the worm pulley and the drive shaft permits independent rotation of the worm gears. Each worm gear is directly coupled to a tuning wrench head with each wrench head connected to a tuning pin. Adjustments between the wrench heads and their connected tuning pins can be made by an external thumb wheel.

It is the primary object of the present invention to provide for an improved apparatus for tuning a piano.

Another object is to provide for the simultaneous tuning of each piano note string.

These and other objects and advantages of the present invention will become apparent to readers from a consideration of the ensuing description and the accompanying drawings.

DESCRIPTION OF THE PREFERRED EMBODIMENT

Figure 1:
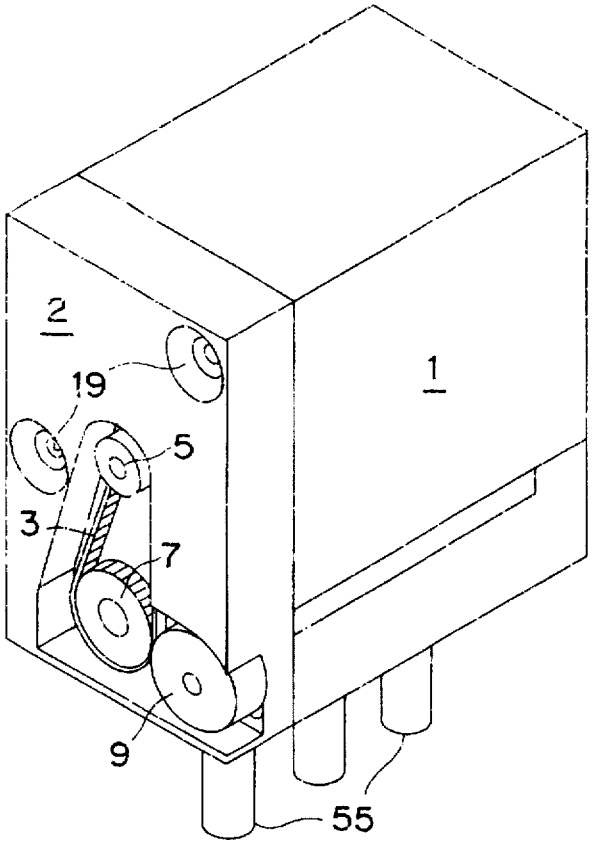
FIG. 1 is a perspective view of the invention's preferred embodiment exterior housing.

FIG. 1 is a perspective view of the invention's preferred embodiment exterior rectangular housing 1. This particular housing has the same height (h) and length (l) dimensions with a (w) dimension slightly more than half that of the height. Visible on the near housing's side 2 are the recessed timing belt 3 and its connected upper 5 and lower 7 pulleys. As shown is the space adjustment thumb wheel 9 used to adjust internal tuning wrenches which engage the piano's tuning pins.

Figure 2:
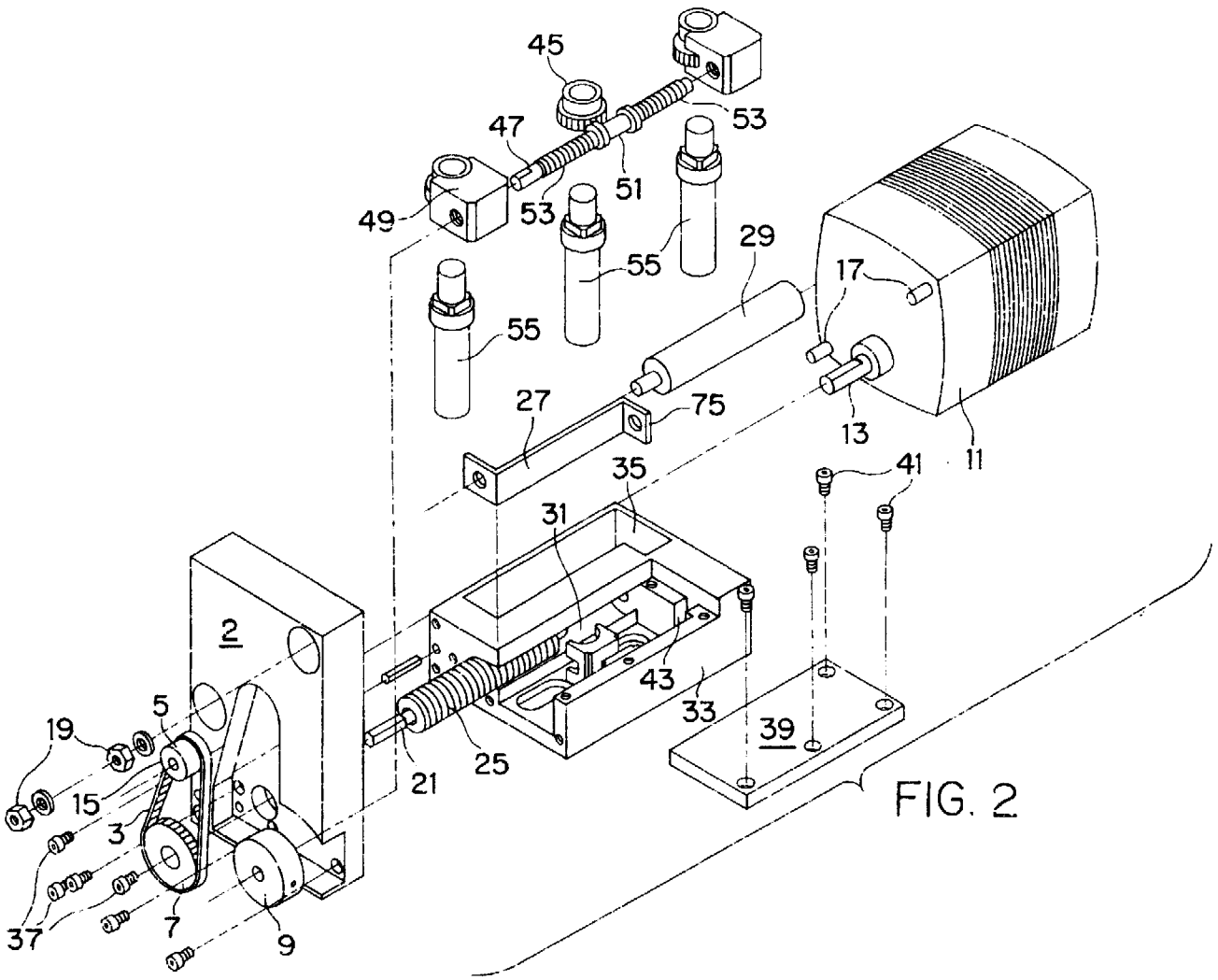
FIG. 2 is a perspective exploded view of the internal components used in FIG. 1.

FIG. 2 is a perspective exploded view showing the mentioned components and the internal components used in FIG. 1. An electrically operated gear motor 11 is connected by its engaging shaft 13 to the center hole 15 in upper timing pulley 5. Motor mounted bolt ends 17 extend through recessed holes in housing side 2 where nut and washers 19 fix them and their motor to the housing. The lower driven timing pulley 7 has a center hub which is set screwed to an hexagonal spline shaft 21 which engages with and extends to the end of rotatable drive shaft 23. Mounted on the drive shaft is a worm gear assembly 25. Beside the worm gear assembly an actuator link slide 27 is used to transmit linear motion from the push/pull solenoid 29 to the drive shaft to move the drive shaft left, right or center. The worm assembly 25 rides in a cylindrical grooved guide way 31 formed in the lower housing section 33 which section receives the actuator link 27 in a right angled housing cutout 35. Several machine screws 37 extend through holes in side 2 to mount lower section 33 to it. A gear box cover plate 39 with its own screws 41 is fastened to the top of housing section 33 at its two facing upper adjacent ledge edges 43. Also, mounted in housing section 33 next to worm assembly 25 and covered by plate 39 are the three spaced identical worm gears 45.

Figure 3:
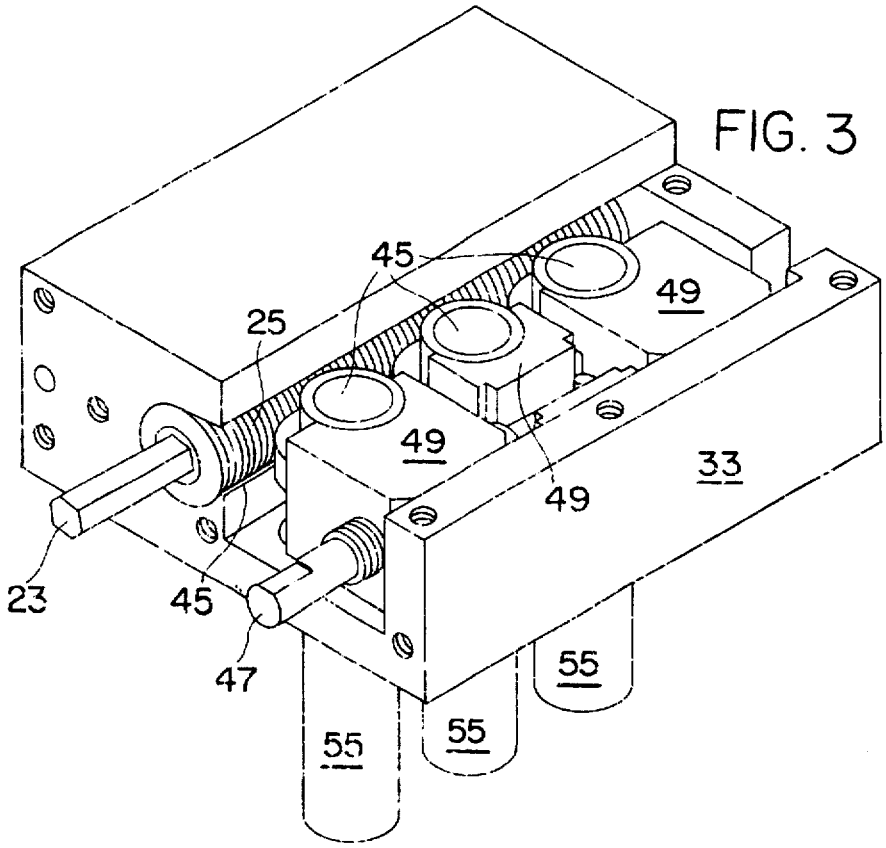
FIG. 3 is a perspective of the internal gear assembly.

A lead screw pin 47 used to adjust the piano tuning pin spacing engages the worm gears 45 as best shown in FIG. 3. Three aligned Nylatron bearing blocks 49 mount the lead screw and the worm gears 45. The center block is stationary and is part of housing 33. At the center of the lead screw pin 47 is a smooth spool section 51 which sets into the stationary center block 49 and has two threaded surfaces 53 on either side (see FIG. 2). The lead screw pin 47 does not touch the worm gears and is threaded into the bearing blocks 49 while the worm gears 45 rotate in the blocks and only engage the worm 25. By shifting drive shaft 23 either to the left, right or center by solenoid 29 one can drive each of the worm gears 45 either direction independently. Extending from and connected to each worm gear is a tuning wrench head 55 used to connect to the piano's tuning pins. Thus, each piano note can have its three strings tuned in unison by these wrenches 55.

Figure 4:
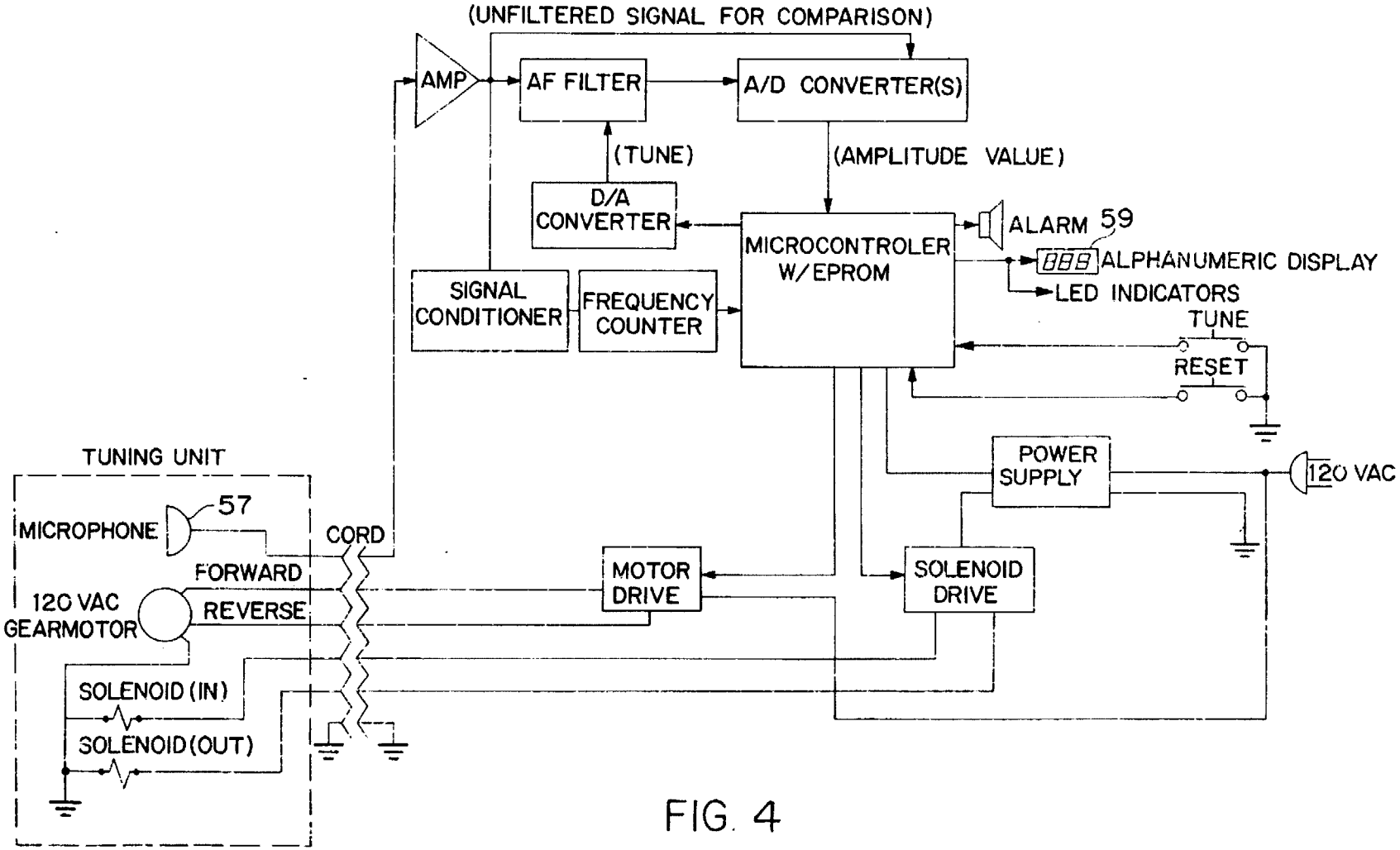
FIG. 4 is an electronic circuit diagram for the components.

FIG. 4 is an electronic circuit diagram for the components. As shown, the basic circuit has a tuning unit with an interconnected condenser microphone 57, a digital readout 59 and LED (light emitting diode) indicators 61. Sounds from the piano's strings are picked up by the microphone, amplified and compared electronically as detailed below. Electric power to run the unit comes from a conventional AC 120 volt line. The microcontroller outputs a signal to both the motor and solenoid drives. These two drives control the movement of the gear motor 11 and solenoid 29, respectively. All these components are conventional electronic components connected as shown to perform as described.

Figure 5:
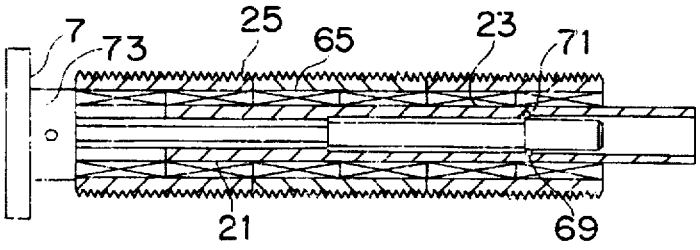
FIG. 5 a cross sectional view showing the drive train in detail.

FIG. 5 is a cross sectional view detailing the drive train used to move the worm assembly 25 in detail. The hexagonal spline 21 is mounted within the center of drive shaft 23. Overrunning clutches 65 surround both the drive shaft and spline. Brass washers 67 retain a compression spring 69 which rides in the same bore as the spline and bears against it. A retaining ring 71 maintains the washers and spring in place. At the unit's pulley 7 engaging end a protruding hub 73 fits into the end housing 2.

Figure 6:
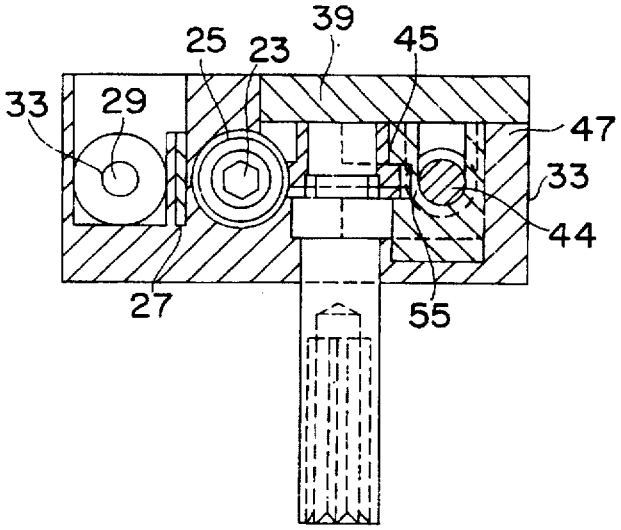
FIG. 6 is a cross sectional side view of a gear components joining to the drive shaft and associated components.

FIG. 6 is a cross sectional side view of a gear components joining to the drive shaft and associated components. In this view, the worm gear 45 joins the drive shaft 25 and its associated components. The shaft of the push/pull solenoid 29 is mounted to the actuator link slide 27. Movement of the link end 75 (see FIG. 2) will result in the reciprocal movement of the drive shaft 25. This movement causes associated clutches to become engaged or disengaged with the drive shaft. The lead screw 47 (see FIG. 3) is connected to the outside housing thumb wheel 9 such that rotation of the thumb wheel will cause the screw to rotate and adjust the worm gear bearing blocks and thus the carried worm gears 45. As screw 47 rotates it can either spread or squeeze (depending on the direction of rotation) the associated worm gears 45 together since these gears are mounted in the movable bearing blocks 49 and therefore they also move with the rotation of threaded screw member 47. The spacer spool 51 (see FIG. 2) is fixed linear to the rotatable screw 47 and its spacing with respect to the two adjacent screw threaded bearing blocks varies based on the carried screw's direction of rotation.

Figure 7A:
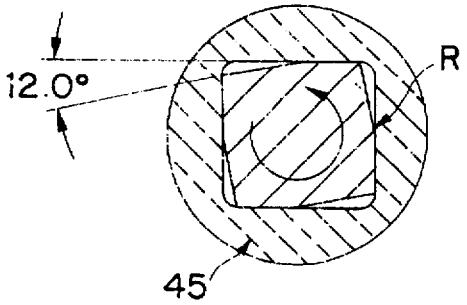
FIG. 7(*a*) shows a cross sectional view of the engagement between the gears and the wrench heads and FIG. 7(*b*) shows in cross section the wrench heads.
Figure 7B:
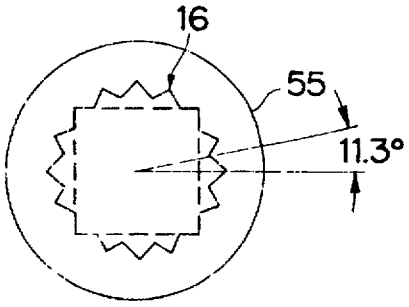

FIG. 7(*a*) shows a cross sectional view of the engagement between the worm gears and the wrench heads. A twelve degree freedom of movement exists to facilitate insertion of the piano's tuning pins into the wrench heads. This is needed as the piano pins may be randomly positioned in orientation. The interior pin engaging surface of the wrench heads is shown in cross section in FIG. 7(*b*). Each of the three wrench heads has a 16 point drive to engage one square piano tuning pin.

Figure 8:
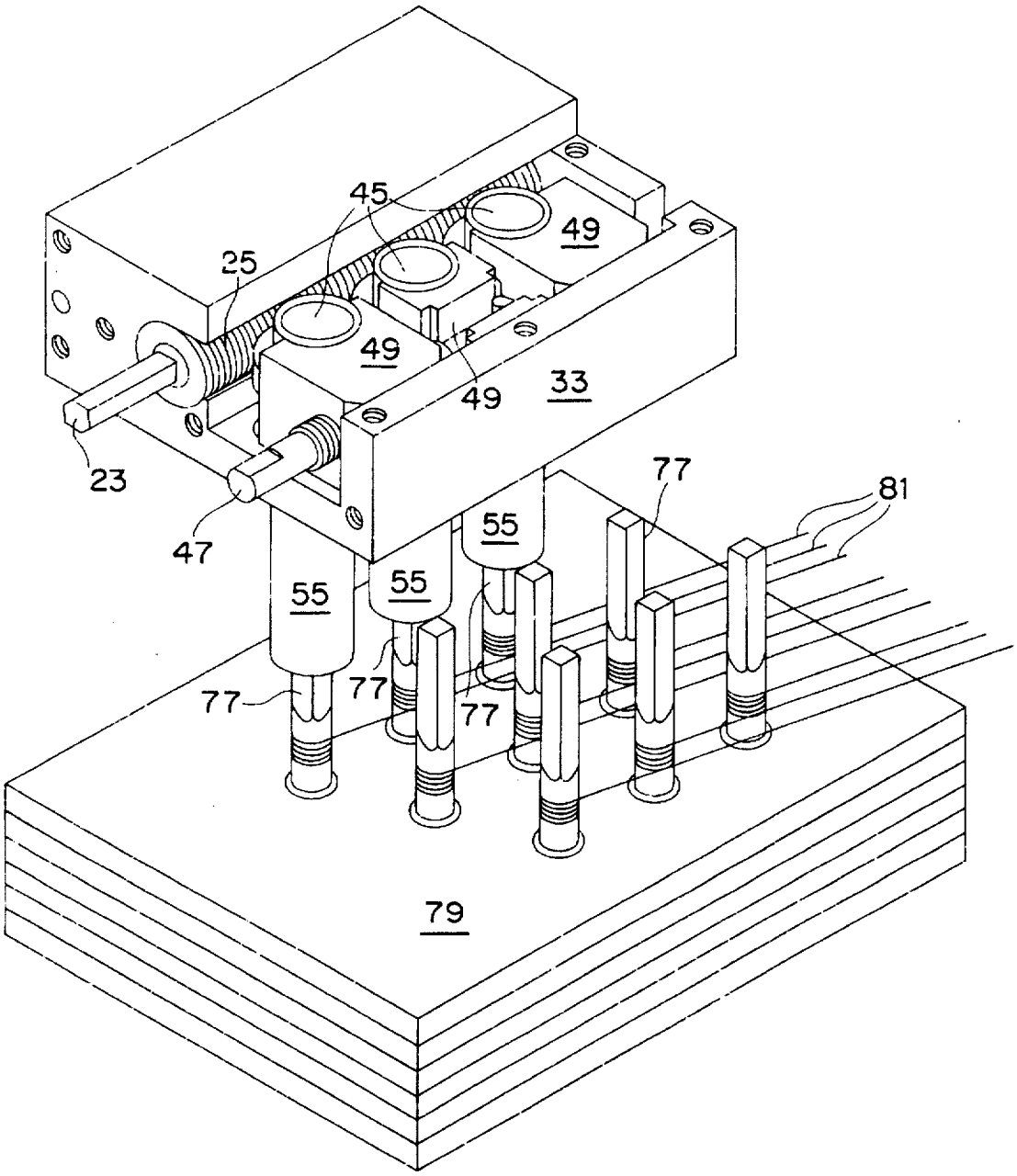
FIG. 8 is a perspective view of the wrench heads engaging the piano's tuning pins.

FIG. 8 is a perspective view of the wrench heads 55 engaging the piano's tuning pins 77 of a typical piano 79. To tune a piano note it should be recognized that all musical sounds are a mixture of pure sinusoidal tones at different frequencies and amplitudes. There is a fundamental tone which is the basic musical note that we hear. This fundamental tone has a larger amplitude than its associated harmonic tones and, for the piano, the lowest frequency of all its tones. The rest of the tones are harmonic overtones and their frequencies and amplitudes determine the "timbre" or distinctive sound of the instrument. A spectral map of these tones is like a signature for an instrument.

A piano is strung in groups of one, two or three strings that are tuned to the same note and are struck simultaneously when playing. When a piano is out of tune these strings will be at slightly different frequencies but they will still have the same spectral signature. With the present invention, a piano is tuned note by note, sequentially starting with its top or highest frequency note. The wrench heads 55 are placed on the proper tuning pins 77 and the corresponding key is struck manually. The sound is picked up by the piano tuner's microphone 57 and amplified. Exact values for the correct frequency of all 88 notes have been digitally stored in memory. First, a tunable band-pass filter, like a radio dial, is tracked from low frequency upward until the fundamental tone is located. The appropriate frequency is then determined from the filter's tuning value and the closest corresponding note stored in memory is displayed. The operator verifies that this is the correct note by pressing the tune button. The filter is then tuned to a frequency below the fundamental tone. The microprocessor then controls the motor and the clutch automatically for one tuning pin to pull it's frequency down until it is seen to appear and disappear from the frequency window. This process is repeated for the note's other two strings. Then the band-pass filter is tuned just below the correct frequency as stored in memory and the strings 81 are tuned upward, one at a time, until each is seen to appear and then disappear from the frequency window. All the strings are now in tune and the process is repeated for the next note down, etc.

Although the automatic piano tuner and the method of using the same according to the present invention has been described in the foregoing specification with considerable details, it is to be understood that modifications may be made to the invention which do not exceed the scope of the appended claims and that modified forms of the present invention done by others skilled in the art to which the invention pertains will be considered infringements of this invention when those modified forms fall within the claimed scope of this invention.

What I claim as my invention is:

1. An apparatus for tuning a piano comprising:

an electronic circuit control system for a drive unit;

said drive unit having an electrically operated gear motor and a driven drive shaft;

a worm driven by said drive shaft and selectively engaged with a plurality of worm gears;

clutch means associated with said drive shaft and connected to and interposed between said shaft and worm for permitting the independent or unison shifting of said worm into engagement with said drive shaft; and a tuning wrench head associated with each worm gear and connectable to a piano's tuning pin, whereby said tuning pins may be adjusted.

2. The invention as claimed in claim 1, also including a housing with spacing adjustment means for said worm gears and associated wrench heads.

3. The invention as claimed in claim 2, wherein there are three worm gears operatively associated with said worm and said adjustment means.

4. The invention as claimed in claim 3, wherein said drive unit includes a movable solenoid and actuator for moving the drive shaft to shift said drive shaft into and out of engagement with said worm.

5. The invention as claimed in claim 4, wherein said drive unit also includes a timing belt and pulleys operatively connected to said drive shaft by means of a spline shaft.

6. The invention as claimed in claim 5, wherein said electronic circuit control system includes a microphone to receive sound from a piano to be tuned and a digital memory storage of all 88 of a piano's fundamental tones to compare against said received sounds.

7. A method for electronically tuning a piano's notes comprising the steps of:

placing a tuning wrench on one of the three tuning pins for a note and striking the corresponding piano key;

receiving and amplifying the sound of the struck key by a microphone and amplifier connected to an electric driver for said tuning wrench;

locating the fundamental tone for the struck key and displaying the closest corresponding note stored in memory;

operator verifying that the correct note has been selected and, if correct, tuning a filter to a frequency below the note's fundamental tone; and repeating the process for the note's two other strings.

* * * * *